US009300098B1

(12) United States Patent
Michaud

(10) Patent No.: US 9,300,098 B1
(45) Date of Patent: Mar. 29, 2016

(54) ADJUSTABLE PAD MOUNT SUBSTATION ADAPTER PLATES

(71) Applicant: Hubbell Incorporated, Shelton, CT (US)

(72) Inventor: Benjamin Joseph Michaud, Hooksett, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/612,366

(22) Filed: Feb. 3, 2015

(51) Int. Cl.

| | |
|---|---|
| ***H01R 11/09*** | (2006.01) |
| ***H01R 31/06*** | (2006.01) |
| ***H01R 4/30*** | (2006.01) |
| ***H01R 4/46*** | (2006.01) |
| ***H01R 4/60*** | (2006.01) |

(52) U.S. Cl.
CPC ..... *H01R 31/06* (2013.01); *H01R 4/30* (2013.01); *H01R 4/46* (2013.01); *H01R 4/60* (2013.01)

(58) Field of Classification Search
USPC ..... 439/796, 797
See application file for complete search history.

(56) References Cited

U.S. PATENT DOCUMENTS

| | | | | |
|---|---|---|---|---|
| 918,617 | A * | 4/1909 | Walsh | H01R 4/363 403/190 |
| 2,783,297 | A * | 2/1957 | Badeau | H02G 7/05 174/44 |
| 4,329,010 | A * | 5/1982 | Balch | H01R 4/46 439/804 |
| 4,687,165 | A | 8/1987 | Blackburn | |
| 6,358,070 | B1 * | 3/2002 | Lin | H01R 25/145 439/115 |
| 7,837,204 | B1 | 11/2010 | Groenenboom | |

FOREIGN PATENT DOCUMENTS

| | | | |
|---|---|---|---|
| EP | 179253 | B1 | 10/2008 |

OTHER PUBLICATIONS

Burndy Substation—Aluminum Bolted Terminal, 2014.
Burndy Aluminum Coupler, Type ALB-V, 2014.

* cited by examiner

*Primary Examiner* — Tho D Ta
(74) *Attorney, Agent, or Firm* — Ohlandt, Greeley, Ruggiero & Perle, L.L.P.

(57) ABSTRACT

An adapter plate is provided for connecting a first conductor pad with a first axis and a second conductor pad with a second axis where the pads have a common bolt pattern. The adapter plate includes a top and bottom surfaces, a first and second ends, a longitudinal axis defined between the ends, and first and second adjustable connectors. The first adjustable connector has arc-shaped slots extending through the top and bottom surfaces at the first end. Similarly, the second adjustable connector has arc-shaped slots extending through the top and bottom surfaces at the second end. The first adjustable connector is connectable to the common bolt pattern so that the top or bottom surface contacts the first conductor pad, while the second adjustable connector is connectable to the common bolt pattern so that the top or bottom surface contacts the second conductor pad.

18 Claims, 8 Drawing Sheets

ADJUSTABLE PAD MOUNT SUBSTATION ADAPTER PLATES

BACKGROUND OF THE INVENTION

1. Field of the Disclosure

The present disclosure is related to pad mount adapter plates for substations. More particularly, the present disclosure is related to pad mount adapter plates that are adjustable to facilitate mechanical and electrical connections.

2. Description of Related Art

Utility companies are challenged with existing substations and or new substation design layouts, and how they will make all electrical and mechanical connections. Because of the many constraints that are within a substation design layout, electrical conductor layouts can be designed in the system at orientations that limit standard connector capabilities.

Today, electrical connector manufacturers design connectors to accommodate special orientation requirements, but those designs are specific to an orientation and conductor range, which makes the connector use and manufacturer stock limited. The limitation can cause for utilities to wait for these non-standard connectors to be made or invest in some inventory of the non-standard connectors.

Therefore, it has been determined by the present disclosure that there is a need for pad mount adapter plates for substations that overcome, alleviate, and/or mitigate one or more of the aforementioned and other deleterious effects of prior art connectors.

SUMMARY

An adapter plate is provided for connecting a first conductor pad with a first axis and a second conductor pad with a second axis where the first and second conductor pads having a common bolt pattern thereon. The adapter plate includes a top surface, a bottom surface, a first end, a second end, a longitudinal axis defined between the first and second ends, and first and second adjustable connectors. The first adjustable connector has a plurality of arc-shaped slots extending through the top and bottom surfaces at the first end. Similarly, the second adjustable connector has a plurality of arc-shaped slots extending through the top and bottom surfaces at the second end. The first adjustable connector is connectable to the common bolt pattern so that the top or bottom surface contacts the first conductor pad, while the second adjustable connector is connectable to the common bolt pattern so that the top or bottom surface contacts the second conductor pad.

In some embodiments alone or in combination with any of the aft mentioned embodiments, the adapter plate further includes a mirror line that is perpendicular to the longitudinal axis and is between first and second adjustable connectors. Here, the first and second adjustable connectors are mirror images of one another along the mirror line.

In some embodiments alone or in combination with any of the afore and/or aft mentioned embodiments, the first adjustable connector is connectable to the common bolt pattern so that the top surface is in contact with the first conductor pad in a neutral position or in a first rotated position and is connectable to the common bolt pattern so that the bottom surface is in contact with the first conductor pad in the neutral position or in a second rotated position, the neutral position having the first axis parallel to the longitudinal axis, the first rotated position having the first axis angled in a first direction with respect to the longitudinal axis, and the second rotated position having the first axis angled in a second direction with respect to the longitudinal axis.

In some embodiments alone or in combination with any of the afore and/or aft mentioned embodiments, the second adjustable connector is connectable to the common bolt pattern so that the top surface is in contact with the second conductor pad in a neutral position or in a first rotated position and is connectable to the common bolt pattern so that the bottom surface is in contact with the second conductor pad in the neutral position or in a second rotated position, the neutral position having the second axis parallel to the longitudinal axis, the first rotated position having the second axis angled in the first direction with respect to the longitudinal axis, and the second rotated position having the second axis angled in the second direction with respect to the longitudinal axis.

In some embodiments alone or in combination with any of the afore and/or aft mentioned embodiments, the adapter plate is linear along the longitudinal axis.

In some embodiments alone or in combination with any of the afore and/or aft mentioned embodiments, the adapter plate has one or more angles and/or curvatures along the longitudinal axis, the one or more angles and/or curvatures being between the first and second adjustable connectors.

In some embodiments alone or in combination with any of the afore and/or aft mentioned embodiments, the one or more angles and/or curvatures are an angle selected from the group consisting of thirty degrees, sixty degrees, and ninety degrees.

In some embodiments alone or in combination with any of the afore and/or aft mentioned embodiments, the angle is parallel to the mirror line.

In some embodiments alone or in combination with any of the afore and/or aft mentioned embodiments, the adapter plate includes an electrically conductive material sufficient to provide an electrical connection between the first and second conductor pads.

In some embodiments alone or in combination with any of the afore and/or aft mentioned embodiments, the plurality of arc-shaped slots of the first and second adjustable connectors each comprise four arc-shaped slots that correspond in number to four openings of the common bolt pattern.

In some embodiments alone or in combination with any of the afore and/or aft mentioned embodiments, the first adjustable connector is connectable to the common bolt pattern so that the top surface is in contact with the first conductor pad in a neutral position or in a first rotated position and being connectable to the common bolt pattern so that the bottom surface is in contact with the first conductor pad in the neutral position or in a second rotated position, the neutral position having the first axis parallel to the longitudinal axis, the first rotated position having the first axis angled in a first direction with respect to the longitudinal axis, and the second rotated position having the first axis angled in a second direction with respect to the longitudinal axis. Further, the second adjustable connector is connectable to the common bolt pattern so that the top surface is in contact with the second conductor pad in a neutral position or in a first rotated position and being connectable to the common bolt pattern so that the bottom surface is in contact with the second conductor pad in the neutral position or in a second rotated position, the neutral position having the second axis parallel to the longitudinal axis, the first rotated position having the second axis angled in the first direction with respect to the longitudinal axis, and the second rotated position having the second axis angled in the second direction with respect to the longitudinal axis.

In some embodiments alone or in combination with any of the afore and/or aft mentioned embodiments, the adapter plate can further include a mirror line that is perpendicular to the longitudinal axis and is between first and second adjustable connectors, the first and second adjustable connectors being mirror image of one another along the mirror line.

In some embodiments alone or in combination with any of the afore and/or aft mentioned embodiments, the adapter plate is linear along the longitudinal axis.

In some embodiments alone or in combination with any of the afore and/or aft mentioned embodiments, the adapter plate has one or more angles and/or curvatures along the longitudinal axis, the one or more angles and/or curvatures being between the first and second adjustable connectors.

In some embodiments alone or in combination with any of the afore and/or aft mentioned embodiments, the one or more angles and/or curvatures are an angle selected from the group consisting of thirty degrees, sixty degrees, and ninety degrees.

In some embodiments alone or in combination with any of the afore and/or aft mentioned embodiments, the adapter place further includes a mirror line that is perpendicular to the longitudinal axis and is between first and second adjustable connectors, the first and second adjustable connectors being mirror image of one another along the mirror line.

In some embodiments alone or in combination with any of the afore and/or aft mentioned embodiments, the angle is parallel to the mirror line.

The above-described and other features and advantages of the present disclosure will be appreciated and understood by those skilled in the art from the following detailed description, and drawings.

DETAILED DESCRIPTION

Figures 1, 2:
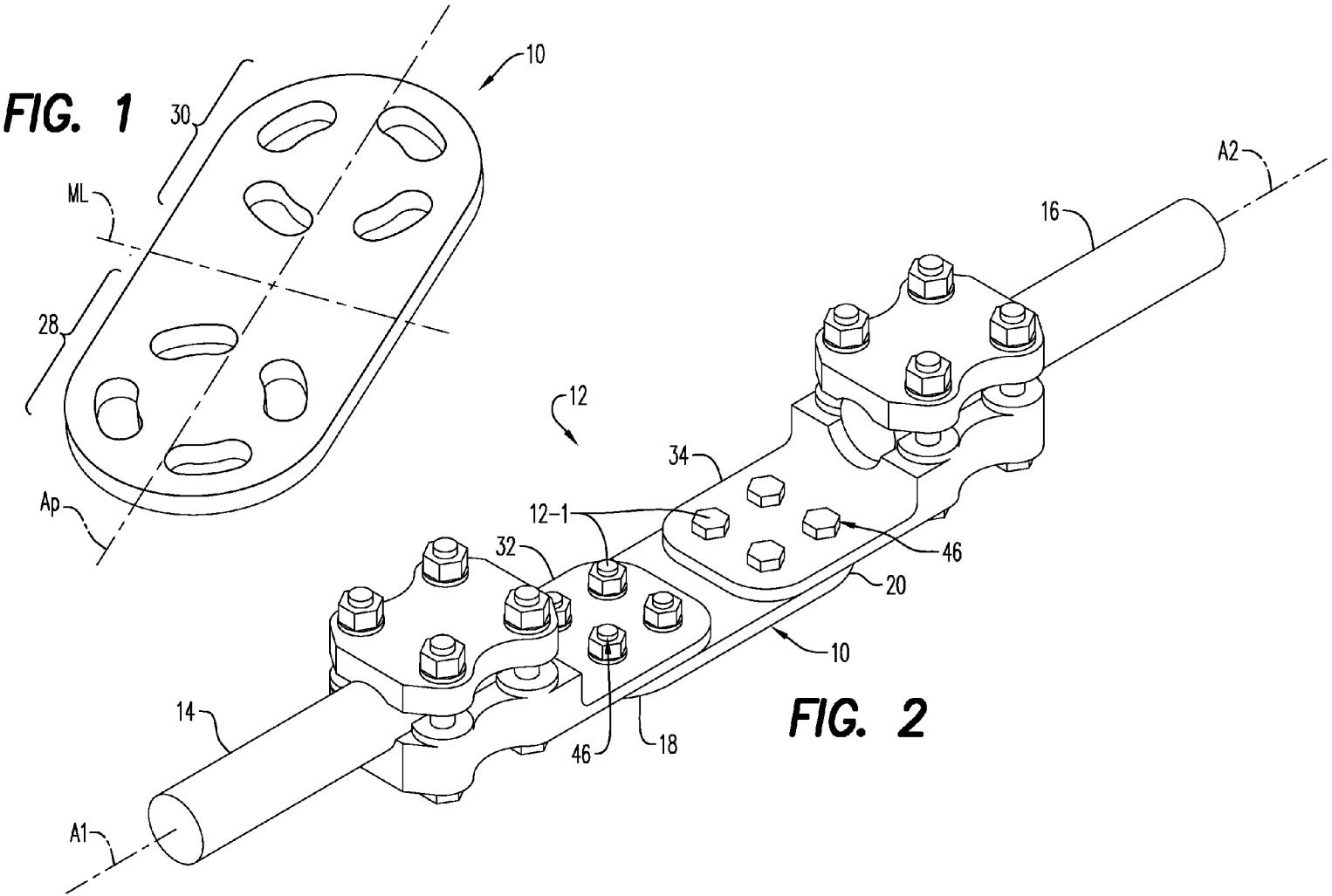
FIG. 1 is an isometric view of an exemplary embodiment of an adjustable adapter plate according to the present disclosure.
FIG. 2 is a perspective view of the adjustable adapter plate of FIG. 1 in use in a junction connection assembly in a neutral position.

Referring to the drawings and in particular to FIGS. 1 and 2, an adjustable adapter plate according to an exemplary embodiment of the present disclosure is shown and is generally referred to by reference numeral 10. Adapter plate 10 is configured to form a junction connection 12 between a first conductor 14 and a second conductor 16.

Advantageously, adapter plate 10 is configured to mechanically and electrically connect conductors 14, 16, illustrated by way of example as electrically conductive pipes, in a manner that is angularly adjustable. Adapter plate 10 is described in detail with simultaneous reference to FIGS. 2-5.

Adapter plate 10 has a first end 18 connected to conductor 14 and a second end 20 connected to conductor 16. In the present embodiment, first and second ends 18, 20 are directly opposing and both terminate in a full radius. Plate 10 further includes a thickness 22 formed between a first or top surface 24 and second or bottom surface 26.

Plate 10 includes a first adjustable connector 28 at first end 18 and a second adjustable connector 30 at second end 20. Conductor 14 has a first connector pad 32 and, similarly, conductor 16 has a second connector pad 34. In this manner, plate 10 is electrically and mechanically connected at first end 18 to first conductor 14 via adjustable connector 28 and pad 32 and electrically and mechanically connected at second end 20 to second conductor 16 via adjustable connector 30 and pad 34.

Adapter plate 10 has a longitudinal axis ($A_p$) defined between first and second ends 18, 20, and a mirror line ($M_L$) that is perpendicular to the longitudinal axis ($A_p$) and is between first and second adjustable connectors 28, 30.

Advantageously, adjustable connectors 28, 30 each form a rotational axis allowing for varying angle adjustment with respect to pads 32, 34, respectively, in at least two directions prior to the tightening of the connections, which is described in more detail with respect to FIGS. 5-10.

Pads 32, 34 can, in some embodiments, form a compression connection with conductors 14, 16, respectively, in a known manner. Of course, it is contemplated by the present disclosure for adapter plate 10 to be secured to pads 32, 34 having any desired connection method to conductors 14, 16.

Adapter plate 10 is also formed of any known electrically conductive material so that, upon connection of adjustable connectors 28, 30 to pads 32, 34, respectively, first and second conductors 14, 16 are in electrical communication with one another. In some embodiments, adapter plate 10 is made of a material such as aluminum, copper, a bi-metallics, and any alloys thereof. As used herein, the term "bi-metallic" shall mean materials that include plated reducing galvanic corrosion or an aluminum plate with a copper sheet molecularly bonded to the aluminum reducing galvanic corrosion. Adapter plate 10 can be formed by any desired method such as, but not limited to, casting, machining, stamping, blanking, power metal, additive manufacturing, and any combinations thereof.

Junction connection 12 is formed using a plurality of tightenable mechanical fasteners 12-1. Fasteners 12-1 pass through pads 32, 34 and through adjustable connectors 28, 30, respectively. Prior to tightening fasteners 12-1, adjustable connectors 28, 30 allow for separate adjustment in the angle between conductor 14 and plate 10 and the angle between conductor 16 and the plate as described in more detail below.

Figure 4:
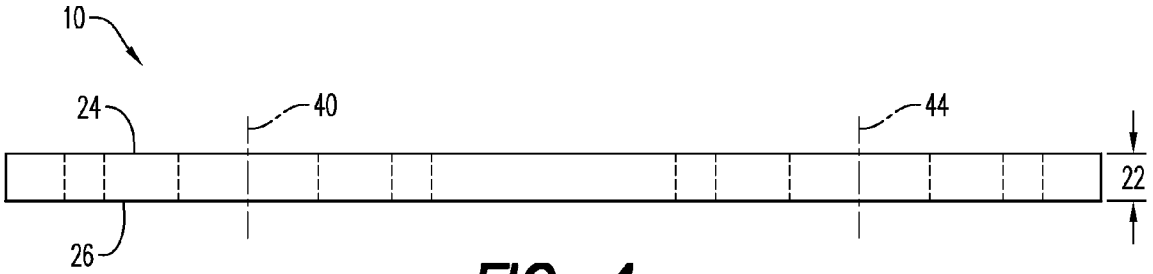
FIG. 4 is a side view of the adapter plate of FIG. 1.

First adjustable connector 28 has a plurality of arc-shaped slots 36 arranged coaxially forming a first mean diameter 38. First mean diameter 38 forms a first rotational axis 40 of adjustment as best seen in FIG. 4. Likewise, second adjustable connector 30 also has a plurality of arc-shaped slots 36 arranged coaxially forming a second mean diameter 42. Similarly, second mean diameter 42 forms a second rotational axis 44 of adjustment which is also best seen in FIG. 4.

For ease of discussion, adjustable connectors 28, 30 are shown each having four slots 36, which correspond in number to the four openings in pads 32, 34 and the four fasteners 12-1 for each pad. Additionally, adjustable connectors 28, 30 are shown having identical arc-shaped slots 36, which allow second ends 18, 20 to be interchangeably connected to pads 32, 34.

Of course, it is contemplated by the present disclosure for adapter plate 10 to have any desired number and/or configuration of slots 36 such as few as two slots to as many as eight or more slots. Slots 36 extend through thickness 22 of plate 10 forming through-slots each configured to receive a respective of one of fasteners 12-1 to provide a securable connection in the desired angles. In one embodiment, fasteners 12-1 are threaded bolt and nut connections.

The ends of slots 36 define first and second terminal positions 36-1, 36-2 for fasteners 12-1, with a radial angle of travel (β) being defined between the terminal positions. In the illustrated embodiment, the radial angle of travel (β) of slots 36 is defined as 30.5 degrees. Of course, it is contemplated by the present disclosure for the radial angle of travel (β) to be more or less than 30.5 degrees and, can depend on a variety of factors such as, but not limited to, the number of slots 36.

In the illustrated embodiment, first terminal position 36-1 of each adjustable connector 28, 30 is positioned so that, when connected to pads 32, 34, with top surface 24 in contact with the pads, junction connection 12 is configured so that first conductor 14 has a longitudinal axis ($A_1$) that is parallel to a longitudinal axis ($A_2$) of second conductor 16 and where longitudinal axes ($A_1$, $A_2$) are parallel to a longitudinal axis ($A_p$) of adapter plate 10. Similarly, terminal position 36-1 of each adjustable connector 28, 30 is also positioned so that, when connected to pads 32, 34, with bottom surface 26 in contact with the pads, junction connection 12 is configured so that first conductor 14 has longitudinal axis ($A_1$) parallel to longitudinal axis ($A_2$) of second conductor 16 and longitudinal axes ($A_1$, $A_2$) are parallel to longitudinal axis ($A_p$) of adapter plate 10. The position where all three longitudinal axes ($A_1$, $A_2$, $A_p$) are parallel and coincident to one another is referred to herein as the neutral position.

Thus, adapter plate 10 is configured, in the illustrated embodiment, having slots 36 with terminal positions 36-1 that allow the plate to be connected to pads with either top surface 24 or bottom surface 26 in contact with the pads and with junction connection 12 in the neutral position. Stated another way, adjustable connector 28 is a mirror image of adjustable connector 30—taken along mirror line ($M_L$) of adapter plate 10. In this manner, adjustable connector 28 is rotated or indexed with respect to adjustable connector 30 allow adapter plate 10 to be configured so that top and/or bottom surfaces 24, 26 can be connected to pads 32, 34, which allows for improved adjustability.

Figure 3:
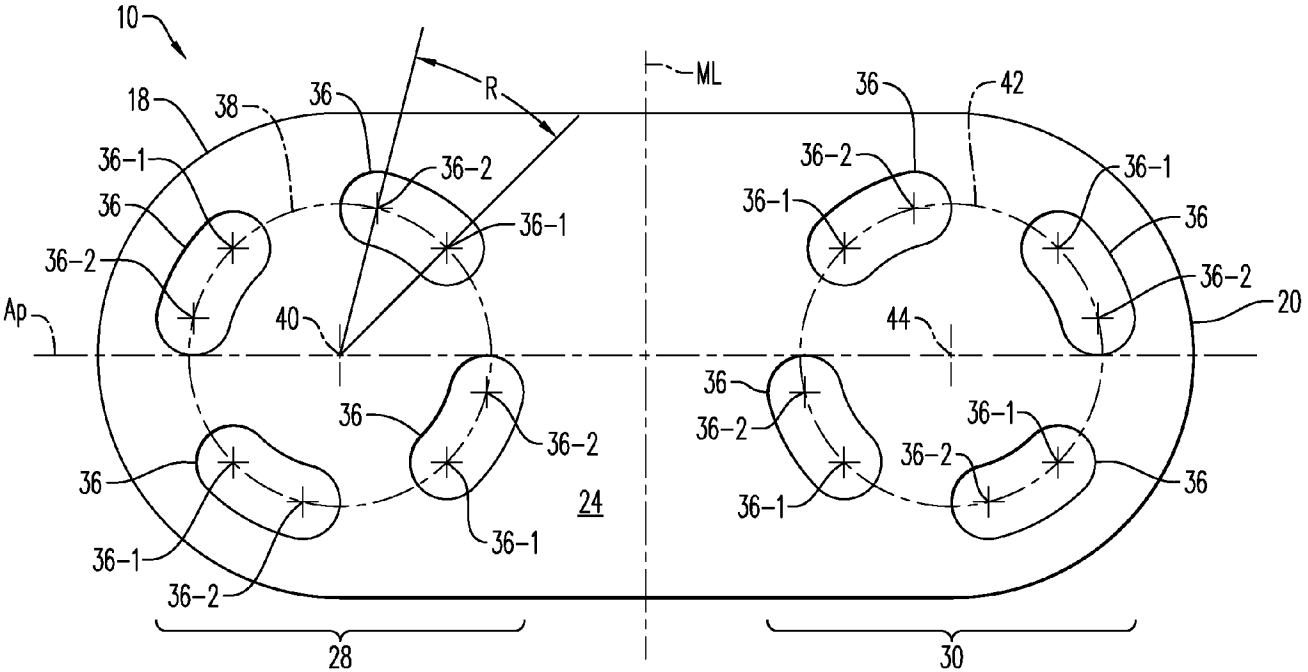
FIG. 3 is a front view of the adapter plate of FIG. 1.

As seen in FIG. 3, if the radial angle of travel (β) of arc-shaped slots 36 is increased, the spacing between adjacent slots is correspondingly decreased. However, as the spacing between slots 36 is minimized, the corresponding strength of plate 10 is also minimized. Advantageously it has been determined by the present disclosure that rotating or indexing connectors 28, 30 with respect to one another allows adapter plate 10 to be secured to connector pads 32, 34 via either top or bottom surface 24,26 to provide maximum adjustability without reducing the structural integrity of the plate as would result from reducing the spacing between slots 36.

Adapter plate 10, when connected to pads 32, 34, is adjustable about rotational first axis 40 and/or second rotational axis 44 along the radial angle of travel (β) of slots 36. Specifically, pads 32, 34 includes a hole-pattern 46 that defines a third mean diameter 48, where first and second mean diameters 38, 42 correspond to the third diameter. In this manner, adapter plate 10 is configured so that when fasteners 12-1 are positioned through pads 32, 34 and adjustable connectors 28, 30, the angle of each adjustable connector 28, 30 can be adjusted by sliding fasteners 12-1 along arc-shaped slots 36.

The angular adjustment combinations are described in more detail with respect to FIGS. 5-10 where adapter plate 10 is shown having first adjustable connector 28 secured by fasteners 12-1 to first pad 32 and second adjustable connector 30 secured by fasteners 12-1 to second pad 34.

Figure 5:
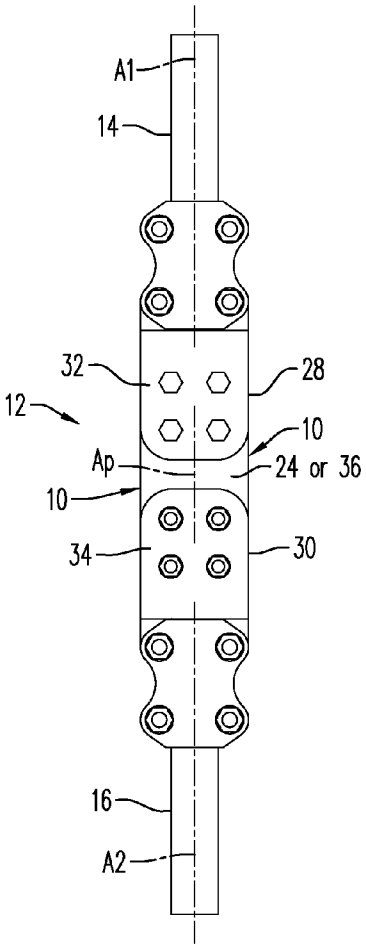

Adapter plate 10 is shown in FIG. 5 with top or bottom surface 24, 26 in contact with pads 32, 34 and adjustable connectors 28, 30 secured by fasteners 12-1 so that longitudinal axis ($A_1$) of first conductor 14, longitudinal axis ($A_2$) of second conductor 16, and longitudinal axis ($A_p$) of plate 10 are parallel and coincident to one another—namely in the neutral position.

Figure 6:
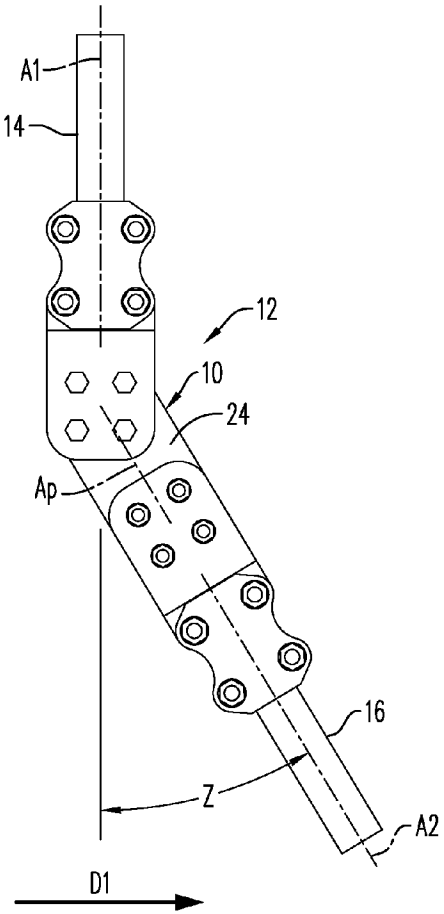

Adapter plate 10 is shown in FIG. 6 with top surface 24 in contact with pads 32, 34 and adjustable connector 30 secured so that longitudinal axis ($A_2$) of second conductor 16 remains parallel and coincident to longitudinal axis ($A_p$) of plate 10, while adjustable connector 28 is secured by fasteners 12-1 so that longitudinal axis ($A_1$) of first conductor 14 is angled with respect to axes (Ap, $A_1$). As a result, plate 10 is configured—when only the adjustment available from adjustable connector 28 is utilized and top surface 24 is in contact with pads 32, 34—so that the axes ($A_1$, $A_2$) of conductors 14, 16 can be angled with respect to one another by angle (Z) that is less than or equal to the radial angle of travel (β) in a first direction ($D_1$).

Figure 7:
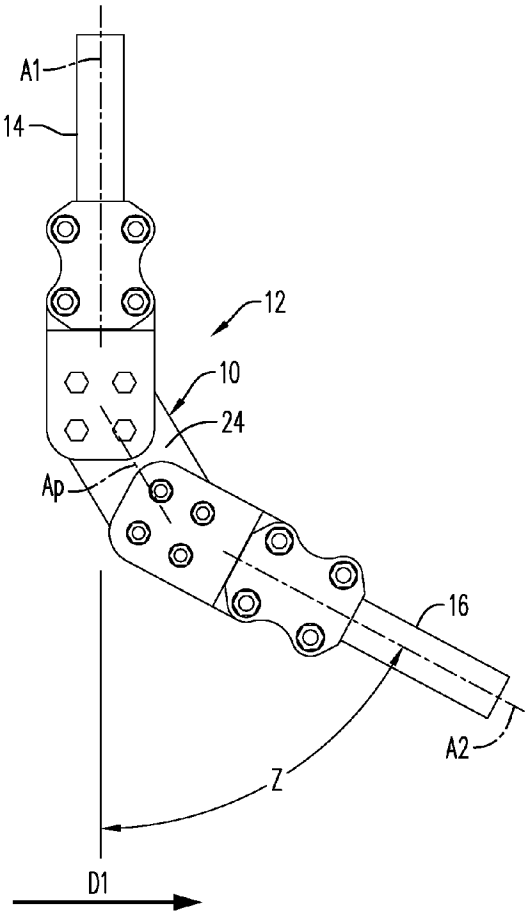
FIGS. 5-10 are front views illustrating the adjustable adapter plate of FIG. 1 adjusting the junction connection assembly to various angles.

Adapter plate 10 is shown in FIG. 7 with top surface 24 in contact with pads 32, 34 and both adjustable connectors 28, 30 secured by fasteners 12-1 so that both longitudinal axes ($A_1$, $A_2$) of conductors 14, 16 are angled with respect to axis (Ap). As a result, plate 10 is configured—when the adjustment available from both adjustable connectors 28, 30 are utilized and top surface 24 is in contact with pads 32, 34—so that the axes ($A_1$, $A_2$) of conductors 14, 16 can be angled with respect to one another by angle (Z) that is less than or equal to twice the radial angle of travel (β) in first direction ($D_1$).

Figure 8:
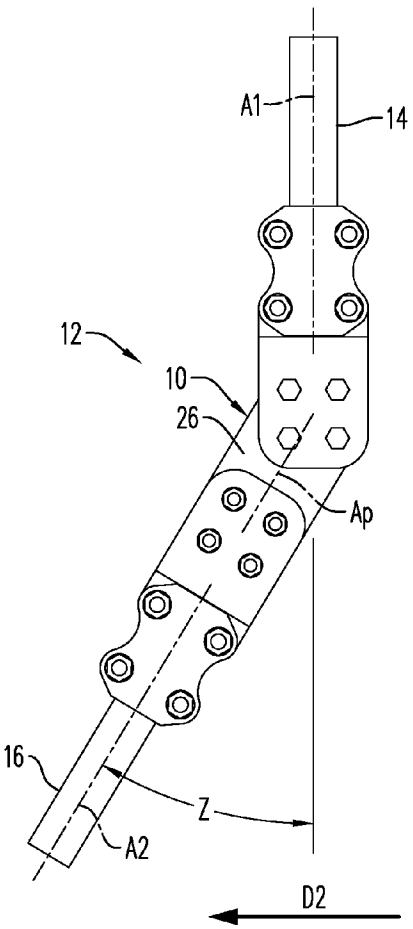

Adapter plate 10 is shown in FIG. 8 with bottom surface 26 in contact with pads 32, 34 and adjustable connector 30 secured so that longitudinal axis ($A_2$) of second conductor 16 remains parallel and coincident to longitudinal axis ($A_p$) of plate 10, while adjustable connector 28 is secured by fasteners 12-1 so that longitudinal axis ($A_1$) of first conductor 14 is angled with respect to axes (Ap, $A_1$). As a result, plate 10 is configured—when only the adjustment available from adjustable connector 28 is utilized and bottom surface 26 is in contact with pads 32, 34—so that the axes ($A_1$, $A_2$) of conductors 14, 16 can be angled with respect to one another by angle (Z) that is less than or equal to the radial angle of travel (β) in a second direction ($D_2$).

Figure 9:
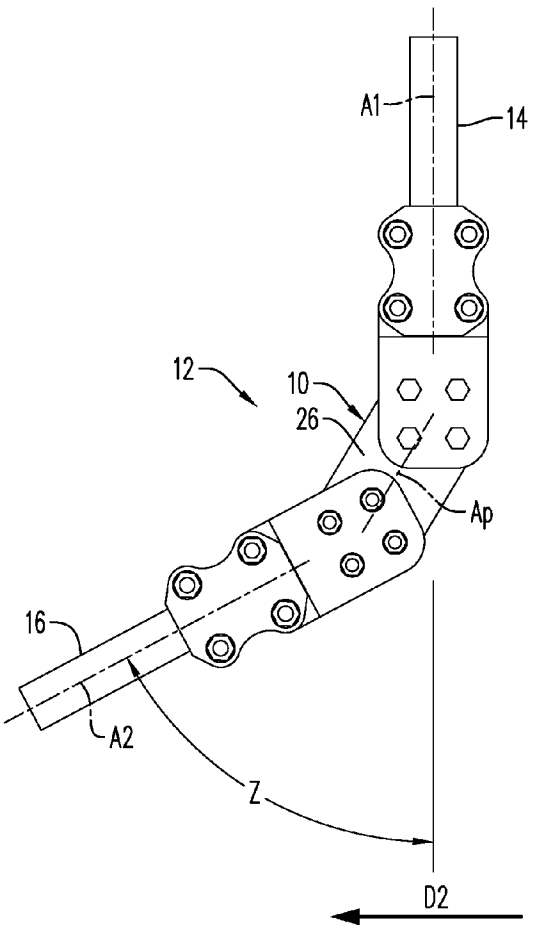

Adapter plate 10 is shown in FIG. 9 with bottom surface 26 in contact with pads 32, 34 and both adjustable connectors 28, 30 secured by fasteners 12-1 so that both longitudinal axes ($A_1$, $A_2$) of conductors 14, 16 are angled with respect to axis (Ap). As a result, plate 10 is configured—when the adjustment available from both adjustable connectors 28, 30 are utilized and bottom surface 26 is in contact with pads 32, 34—so that the axes ($A_1$, $A_2$) of conductors 14, 16 can be angled with respect to one another by angle (Z) that is less than or equal to twice the radial angle of travel (β) in second direction ($D_1$).

Stated another way, adapter plate 10 is advantageously configured so that the ability to rotate be in the neutral position, to rotate in first direction ($D_1$), or rotate in second ($D_2$) is a function of whether top or bottom surface 24, 26 of the plate is secured to pads 32, 34, respectively.

Figure 10:
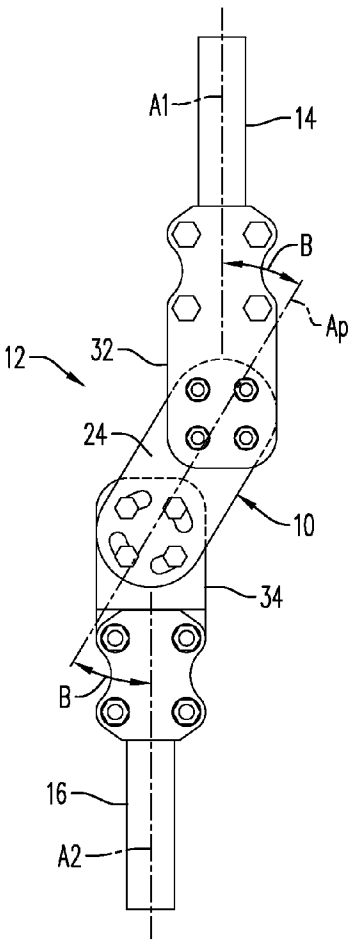

Adapter plate 10 is also advantageously configured to allow for adjustment in both first and second directions ($D_1$, $D_2$) as shown in FIG. 10. Here, adapter plate 10 is shown with top surface 24 in contact with pad 32, bottom surface 26 in contact with pad 34 and both adjustable connectors 28, 30 secured by fasteners 12-1 so that both longitudinal axes ($A_1$, $A_2$) of conductors 14 are angled with respect to axis (Ap). As a result, adapter plate 10 is configured—when the adjustment available from both adjustable connectors 28, 30 are utilized and top/bottom surfaces 24, 26 are in contact with pads 32, 34, respectively—so that the axes ($A_1$, $A_2$) of conductors 14, 16 can be parallel to one another, but offset from one another and each angled with respect to longitudinal axis ($A_p$) of adapter plate 10 by angle (Z) that is less than or equal to the radial angle of travel (β) in first and second directions ($D_1$, $D_2$), respectively.

Accordingly, it has been determined by the present disclosure that the simple structure of adapter plate 10 is particularly useful at accommodating the interconnection of conductors 14, 16 as junction connection 12 with a variety of different angles.

It should be recognized that adapter plate 10 is disclosed above by way of example as being a flat plate—namely linear along plate axis ($A_p$). Of course, it is contemplated by the present disclosure for adapter plate 10 to have any desired angle or curvature or number of steps. Exemplary embodiments of angled adapter plates according to the present disclosure are shown in FIGS. 11-16 and disclosed in more detail below. Here, component parts having similar or analogous features to those discussed above with respect to adapter plate 10 are numbered in multiples of one hundred.

Figure 12:
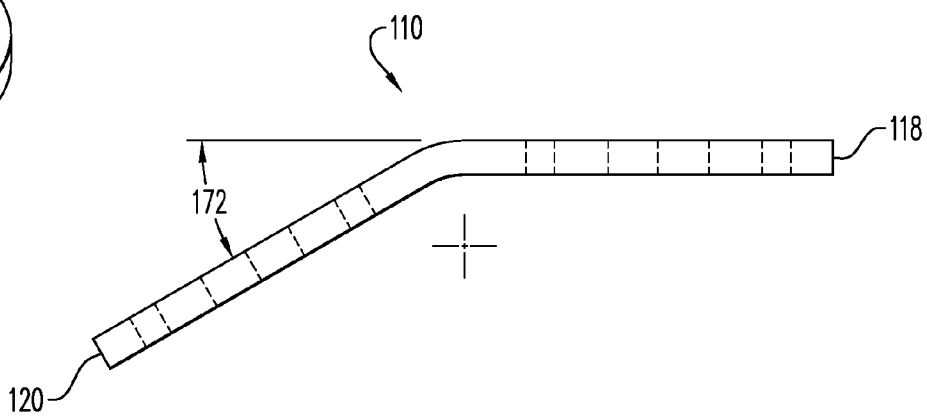
FIG. 12 is a side view of the adapter plate of FIG. 11.
Figure 11:
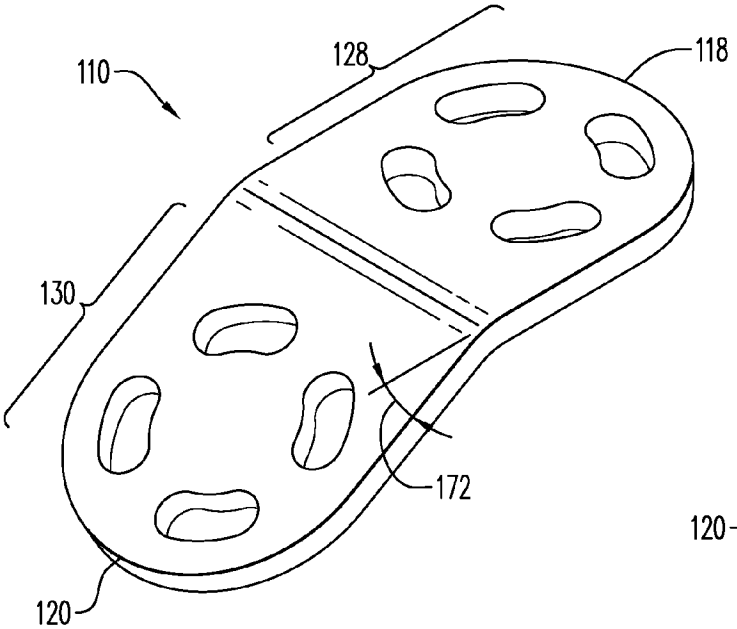
FIG. 11 is an isometric view of another alternate exemplary embodiment of an adapter plate according to the present disclosure.

Starting with the embodiment illustrated in FIGS. 11 and 12, an exemplary embodiment of an angled adapter plate according to the present disclosure is shown and is generally referred to by numeral 110. Adapter plate 110 includes first end 118 having first adjustable connector 128 and second end 120 have second adjustable connector 130, where the first and second adjustable connectors function in the manner discussed above.

Additionally, adapter plate 110 further includes an angle 172 between adjustable connectors 128, 130. In the illustrated embodiment, angle 172 is shown as being thirty degrees. Advantageously, angle 172 provides adapter plate 110 with additional versatility in adjustably connecting the conductors (not shown) to one another.

Although not illustrated, it will be appreciated that adapter plate 110 provides the same versatility in adjustment to that described above with respect to adapter plate 10. Namely, adapter plate 110 has adjustable connectors 128, 130 that are mirror images of one another so that the top and/or bottom surface of the adapter plate can be secured to the pads in the neutral position. In this manner adapter plate 110, can be connected to the pads of the conductors, so that the pads can be adjusted along the radial angle of travel of the slots in either the first direction, the second direction, or both.

Figure 14:
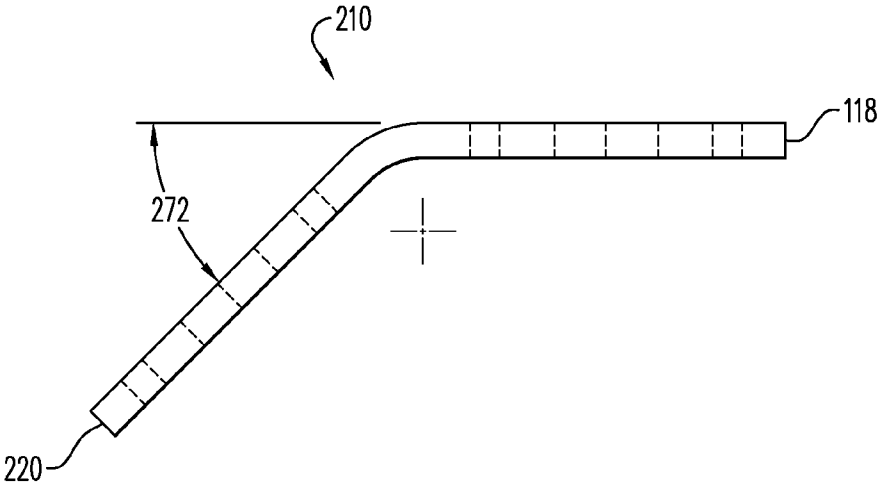
FIG. 14 is a side view of the adapter plate of FIG. 13.
Figure 13:
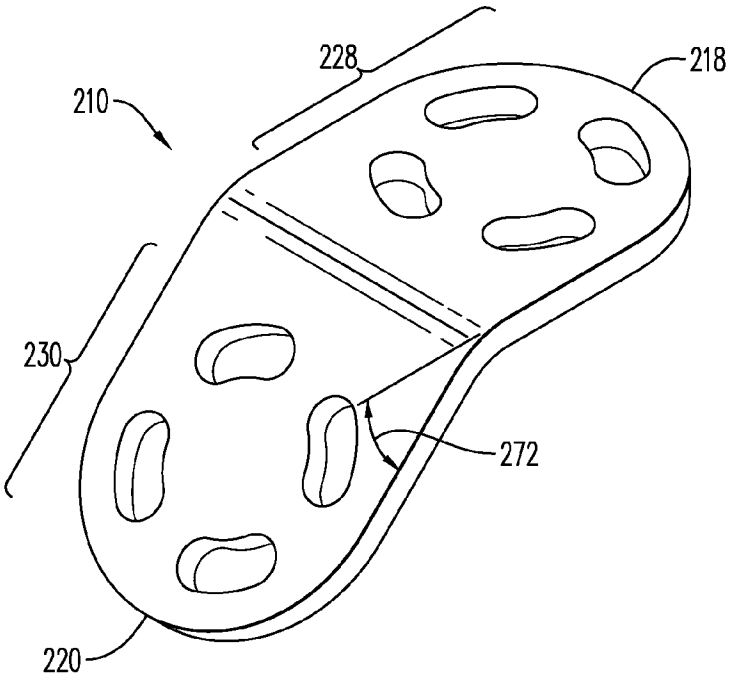
FIG. 13 is an isometric view of another alternate exemplary embodiment of an adapter plate according to the present disclosure.

Turning to the embodiment illustrated in FIGS. 13 and 14, an angled adapter plate according to the present disclosure is shown and is generally referred to by numeral 210. Adapter plate 210 includes first end 218 having first adjustable connector 228 and second end 220 have second adjustable connector 230, which function in the manner discussed above.

Additionally, adapter plate 210 further includes an angle 272 between adjustable connectors 228, 230. In the illustrated embodiment, angle 272 is shown as being forty five degrees. Advantageously, angle 272 provides adapter plate 210 with additional versatility in adjustably connecting the conductors (not shown) to one another.

Figure 16:
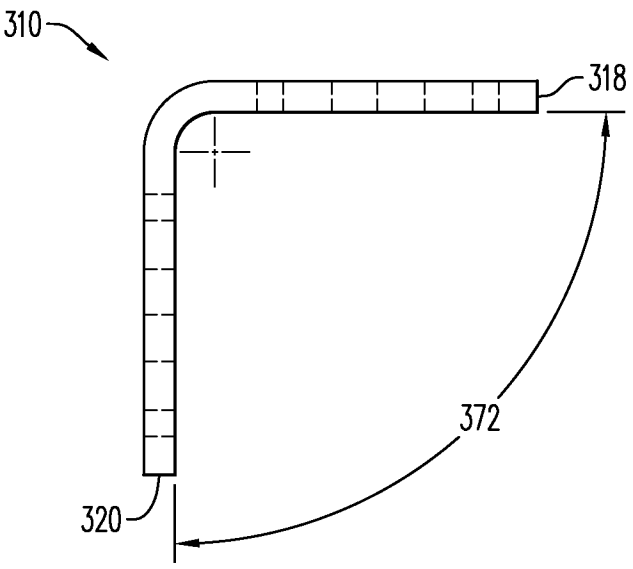
FIG. 16 is a side view of the adapter plate of FIG. 15.
Figure 15:
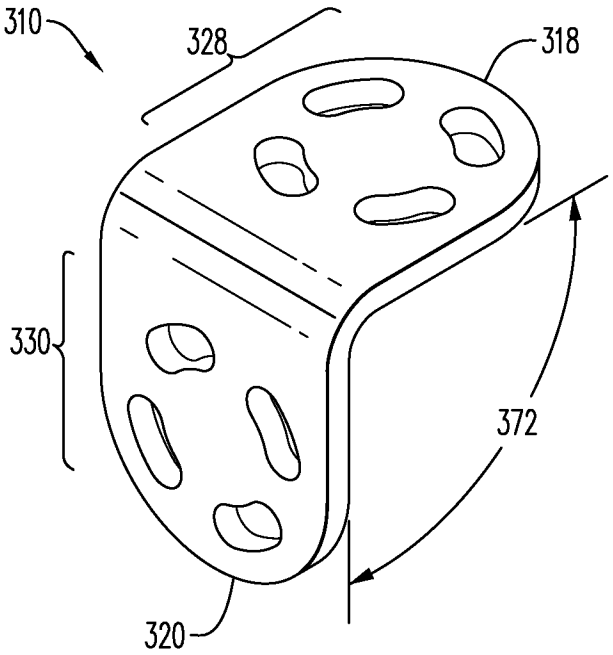
FIG. 15 is an isometric view of another alternate exemplary embodiment of an adapter plate according to the present disclosure.

Turning to the embodiment illustrated in FIGS. 15 and 16, an angled adapter plate according to the present disclosure is shown and is generally referred to by numeral 310. Adapter plate 310 has first end 318 with first adjustable connector 328 and second end 320 with second adjustable connector 330. Here, adapter plate 310 includes an angle 372 between adjustable connectors 328, 330 that is illustrated as being ninety degrees. Advantageously, angle 272 provides adapter plate 210 with additional versatility in adjustably connecting the conductors (not shown) to one another.

It should be recognized that the adapter plate of the present disclosure is not limited to the angles discussed above, but rather can have any desired angle between the first and second adjustable connectors. That angle can be a single angle or can be a curvature or a number of different angles in different directions. In addition, that angle can be a compound angle—namely one that is askew with respect to mirror line (MD.

Figure 17:
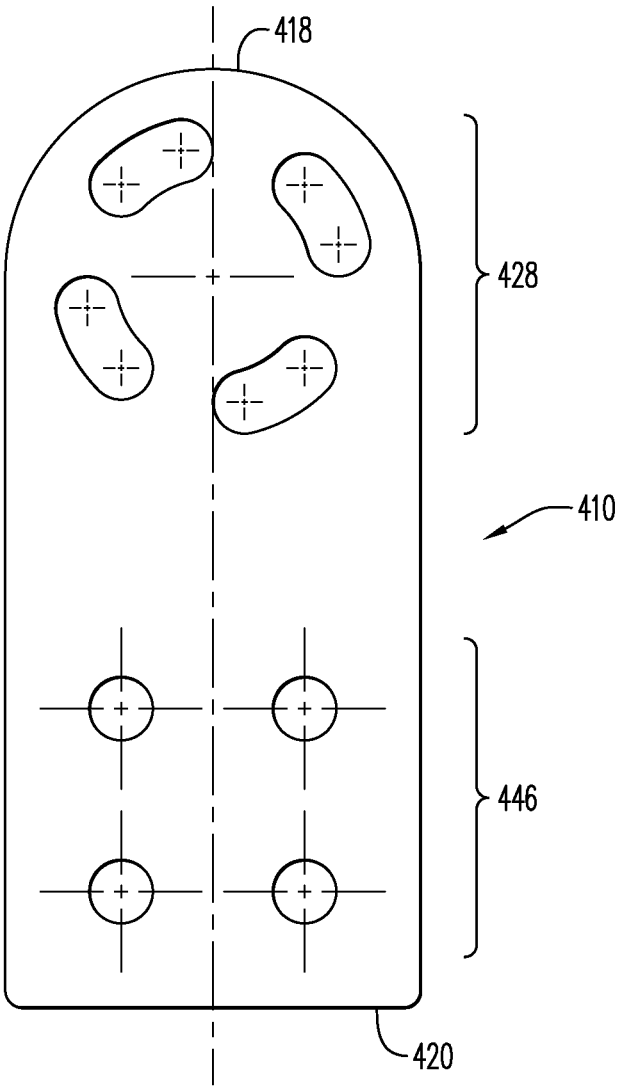
FIG. 17 is a front view of an alternate exemplary embodiment of an adjustable adapter plate according to the present disclosure.

It should also be recognized that adapter plate 10, 110, 210, 310 is disclosed above by way of example as having adjustable connectors on both ends. However, it is also contemplated by the present disclosure for the adapter plate to have only one adjustable connector. An exemplary embodiment of such a single ended adapter plate according to the present disclosure is shown in FIG. 17 and disclosed in more detail below. Here, component parts having similar or analogous features to those discussed above with respect to adapter plate 10 are numbered in multiples of one hundred.

In FIG. 17, an angled adapter plate according to the present disclosure is shown and is generally referred to by numeral 410 that has first end 418 with first adjustable connector 428 and second end 420 with a rigid or non-adjustable connector 446, which has a bolt pattern that matches the bolt pattern 46 discussed above with respect to pads 32, 34.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. In addition combinations of the different features can be combined to create different products. Therefore, it is intended that the present disclosure not be limited to the particular embodiment(s) disclosed as the best mode contemplated, but that the disclosure will include all embodiments falling within the scope of the present disclosure.

What is claimed is:

1. An adapter plate for connecting a first conductor pad with a first axis and a second conductor pad with a second axis, the first and second conductor pads having a common bolt pattern thereon, the adapter plate comprising:

a top surface and a bottom surface;

a first end and a second end;

a longitudinal axis defined between the first and second ends;

a first adjustable connector having a plurality of arc-shaped slots extending through the top and bottom surfaces at the first end, the first adjustable connector being connectable to the common bolt pattern so that the top or bottom surface contacts the first conductor pad;

a second adjustable connector having a plurality of arc-shaped slots extending through the top and bottom surfaces at the second end, the second adjustable connector being connectable to the common bolt pattern so that the top or bottom surface contacts the second conductor pad; and a mirror line that is perpendicular to the longitudinal axis and is between first and second adjustable connectors, the first and second adjustable connectors being mirror images of one another along the mirror line.

2. The adapter plate of claim 1, wherein the first adjustable connector is connectable to the common bolt pattern so that the top surface is in contact with the first conductor pad in a neutral position or in a first rotated position and is connectable to the common bolt pattern so that the bottom surface is in contact with the first conductor pad in the neutral position or in a second rotated position, the neutral position having the first axis parallel to the longitudinal axis, the first rotated position having the first axis angled in a first direction with respect to the longitudinal axis, and the second rotated position having the first axis angled in a second direction with respect to the longitudinal axis.

3. The adapter plate of claim 2, wherein the second adjustable connector is connectable to the common bolt pattern so that the top surface is in contact with the second conductor pad in a neutral position or in a first rotated position and is connectable to the common bolt pattern so that the bottom surface is in contact with the second conductor pad in the neutral position or in a second rotated position, the neutral position having the second axis parallel to the longitudinal axis, the first rotated position having the second axis angled in the first direction with respect to the longitudinal axis, and the second rotated position having the second axis angled in the second direction with respect to the longitudinal axis.

4. The adapter plate of claim 1, wherein the adapter plate is linear along the longitudinal axis.

5. The adapter plate of claim 1, wherein the adapter plate has one or more angles and/or curvatures along the longitudinal axis, the one or more angles and/or curvatures being between the first and second adjustable connectors.

6. The adapter plate of claim 5, wherein the one or more angles and/or curvatures comprise an angle selected from the group consisting of thirty degrees, sixty degrees, and ninety degrees.

7. The adapter plate of claim 6, wherein the angle is parallel to the mirror line.

8. The adapter plate of claim 1, wherein the adapter plate comprises an electrically conductive material sufficient to provide an electrical connection between the first and second conductor pads.

9. The adapter plate of claim 1, wherein the plurality of arc-shaped slots of the first and second adjustable connectors each comprise four arc-shaped slots that correspond in number to four openings of the common bolt pattern.

10. An adapter plate for creating a junction connection between a first conductor pad with a first axis and a second conductor pad with a second axis, the first and second conductor pads having a common bolt pattern thereon, the adapter plate comprising:

a top surface and a bottom surface;

a first end and a second end;

a longitudinal axis defined between the first and second ends;

a first adjustable connector having a plurality of arc-shaped slots extending through the top and bottom surfaces at the first end, the first adjustable connector being connectable to the common bolt pattern so that the top surface is in contact with the first conductor pad in a neutral position or in a first rotated position and being connectable to the common bolt pattern so that the bottom surface is in contact with the first conductor pad in the neutral position or in a second rotated position, the neutral position having the first axis parallel to the longitudinal axis, the first rotated position having the first axis angled in a first direction with respect to the longitudinal axis, and the second rotated position having the first axis angled in a second direction with respect to the longitudinal axis; and a second adjustable connector having a plurality of arc-shaped slots extending through the top and bottom surfaces at the second end, the second adjustable connector being connectable to the common bolt pattern so that the top surface is in contact with the second conductor pad in a neutral position or in a first rotated position and being connectable to the common bolt pattern so that the bottom surface is in contact with the second conductor pad in the neutral position or in a second rotated position, the neutral position having the second axis parallel to the longitudinal axis, the first rotated position having the second axis angled in the first direction with respect to the longitudinal axis, and the second rotated position having the second axis angled in the second direction with respect to the longitudinal axis.

11. The adapter plate of claim 10, further comprising a mirror line that is perpendicular to the longitudinal axis and is between first and second adjustable connectors, the first and second adjustable connectors being mirror images of one another along the mirror line.

12. The adapter plate of claim 10, wherein the adapter plate is linear along the longitudinal axis.

13. The adapter plate of claim 10, wherein the adapter plate has one or more angles and/or curvatures along the longitudinal axis, the one or more angles and/or curvatures being between the first and second adjustable connectors.

14. The adapter plate of claim 13, wherein the one or more angles and/or curvatures comprise an angle selected from the group consisting of thirty degrees, sixty degrees, and ninety degrees.

15. The adapter plate of claim 14, further comprising a mirror line that is perpendicular to the longitudinal axis and is between first and second adjustable connectors, the first and second adjustable connectors being mirror image of one another along the mirror line.

16. The adapter plate of claim 15, wherein the angle is parallel to the mirror line.

17. The adapter plate of claim 10, wherein the adapter plate comprises an electrically conductive material sufficient to provide an electrical connection between the first and second conductor pads.

18. The adapter plate of claim 10, wherein the plurality of arc-shaped slots of the first and second adjustable connectors each comprise four arc-shaped slots that correspond in number to four openings of the common bolt pattern.

* * * * *